US008764573B2

(12) United States Patent
Johnson et al.

(10) Patent No.: US 8,764,573 B2
(45) Date of Patent: Jul. 1, 2014

(54) GAMING MACHINE CABINET

(75) Inventors: Richard Johnson, Las Vegas, NV (US); Yuji Taniguchi, Las Vegas, NV (US); Steve Sutherland, Henderson, NV (US)

(73) Assignee: Konami Gaming, Inc., Las Vegas, NV (US)

( * ) Notice: Subject to any disclaimer, the term of this patent is extended or adjusted under 35 U.S.C. 154(b) by 633 days.

(21) Appl. No.: 12/287,438

(22) Filed: Oct. 8, 2008

(65) Prior Publication Data

US 2010/0087259 A1 Apr. 8, 2010

(51) Int. Cl.
*A63F 9/00* (2006.01)

(52) U.S. Cl.
USPC ..... 463/46

(58) Field of Classification Search
USPC ..... 463/20
See application file for complete search history.

(56) References Cited

U.S. PATENT DOCUMENTS

| | | | | |
|---|---|---|---|---|
| 5,813,914 | A | 9/1998 | McKay et al. | |
| 6,201,532 | B1 | 3/2001 | Tode et al. | |
| 6,554,704 | B2 * | 4/2003 | Nicastro et al. | 463/20 |
| 6,575,833 | B1 * | 6/2003 | Stockdale | 463/29 |
| 6,699,128 | B1 | 3/2004 | Beadell et al. | |
| 6,773,348 | B2 * | 8/2004 | Stockdale | 463/29 |
| 6,820,875 | B1 | 11/2004 | Hedrick et al. | |
| 7,083,168 | B2 * | 8/2006 | Seelig et al. | 273/142 HA |
| 7,258,610 | B2 * | 8/2007 | Seelig et al. | 463/20 |
| 7,316,610 | B2 * | 1/2008 | Seelig et al. | 463/17 |
| 7,563,165 | B2 * | 7/2009 | Seelig et al. | 463/20 |
| 7,775,888 | B2 * | 8/2010 | Wudtke | 463/46 |
| 7,892,098 | B2 * | 2/2011 | Nguyen et al. | 463/46 |
| 8,012,026 | B2 * | 9/2011 | Dreyer et al. | 463/46 |
| 8,113,517 | B2 * | 2/2012 | Canterbury et al. | 273/148 B |
| 8,210,949 | B2 * | 7/2012 | Graf | 463/46 |
| 2002/0032051 | A1 * | 3/2002 | Stockdale | 463/29 |
| 2004/0009807 | A1 * | 1/2004 | Miller et al. | 463/20 |
| 2004/0224776 | A1 | 11/2004 | Nagano | |
| 2004/0229693 | A1 | 11/2004 | Lind et al. | |
| 2005/0026702 | A1 | 2/2005 | Cole | |
| 2005/0049028 | A1 * | 3/2005 | Gornez et al. | 463/20 |
| 2005/0049034 | A1 * | 3/2005 | Kojima | 463/20 |
| 2005/0215325 | A1 * | 9/2005 | Nguyen et al. | 463/46 |
| 2006/0135246 | A1 * | 6/2006 | Okada | 463/20 |
| 2006/0160607 | A1 * | 7/2006 | Okada | 463/21 |
| 2006/0178204 | A1 * | 8/2006 | Okada | 463/20 |
| 2006/0247005 | A1 * | 11/2006 | Tanimura | 463/20 |

(Continued)

FOREIGN PATENT DOCUMENTS

WO WO 2007/027489 A2 3/2007

OTHER PUBLICATIONS

Examiner's first report on Australian Patent Application No. 2009222534, dispatched date Aug. 23, 2010, IP Australia.

(Continued)

*Primary Examiner* — Seng H Lim
(74) *Attorney, Agent, or Firm* — Masuvalley & Partners

(57) ABSTRACT

A gaming machine, including a first cabinet including a first display for displaying a first game or information for the gaming machine, a second cabinet including a second display for displaying a second game, and a third cabinet including an input device for playing the game, wherein an area of a top surface of the third cabinet is wider than an area of a bottom surface of the second cabinet or a bottom surface of the first cabinet.

26 Claims, 12 Drawing Sheets

(56) References Cited

U.S. PATENT DOCUMENTS

| | | | | |
|---|---|---|---|---|
| 2006/0252496 | A1* | 11/2006 | Rasmussen | 463/20 |
| 2007/0037624 | A1* | 2/2007 | Mitchell et al. | 463/20 |
| 2007/0060298 | A1* | 3/2007 | Vallejo | 463/20 |
| 2007/0066383 | A1* | 3/2007 | Mori et al. | 463/20 |
| 2007/0129145 | A1* | 6/2007 | Blackburn et al. | 463/42 |
| 2007/0197301 | A1 | 8/2007 | Cole | |
| 2008/0085750 | A1* | 4/2008 | Yoshizawa | 463/13 |
| 2008/0113741 | A1* | 5/2008 | Beadell et al. | 463/20 |
| 2008/0119263 | A1* | 5/2008 | Haga et al. | 463/20 |
| 2008/0119288 | A1 | 5/2008 | Rasmussen | |
| 2008/0119289 | A1 | 5/2008 | Lind et al. | |
| 2008/0153569 | A1* | 6/2008 | Tanabe | 463/20 |
| 2008/0220847 | A1* | 9/2008 | Okada | 463/20 |
| 2008/0254880 | A1* | 10/2008 | Dreyer et al. | 463/31 |
| 2008/0293476 | A1* | 11/2008 | Luciano et al. | 463/20 |
| 2008/0311976 | A1* | 12/2008 | Hashimoto | 463/20 |
| 2009/0005178 | A1* | 1/2009 | Abe et al. | 463/46 |
| 2009/0069070 | A1* | 3/2009 | Crowder et al. | 463/20 |
| 2009/0209324 | A1* | 8/2009 | Graf | 463/25 |
| 2010/0004049 | A1* | 1/2010 | Ching et al. | 463/20 |
| 2010/0062827 | A1* | 3/2010 | Hoffman et al. | 463/20 |
| 2010/0248814 | A1* | 9/2010 | Carson et al. | 463/25 |
| 2012/0142412 | A1* | 6/2012 | Carson et al. | 463/25 |

OTHER PUBLICATIONS

Examiner's first report on AU patent application No. 2011202630, issued on Jul. 19, 2011, IP Australia.

* cited by examiner

GAMING MACHINE CABINET

The present invention relates to a gaming machine cabinet for gaming machines, which are used in casinos, particularly relates to a gaming machine cabinet having a modular structure with an ergonomic structure suitable for players of the gaming machines.

BACKGROUND

In a current gaming machine cabinet or housing, there are two types of gaming machines from the viewpoint of the gaming machine cabinet structures. One of them is a gaming machine configuration, which is referred to as "an upright" or "an arcade" configuration, and the other gaming machine configuration is a gaming machine, which is referred to as "a slant top" configuration.

The upright gaming machine is generally tall and narrow structure as disclosed by The United States Patent Application Publication No. 2004/0224776 to Nagano, which teaches the "upright" or "arcade" configurations of the gaming machine.

The other gaming machine configuration is referred to as a "slant top" as disclosed in the U.S. Pat. No. 6,201,532B1 to Tode et al and The United States Patent Application Publication No. 2005/0026702 to Cole. Typically, theses gaming machines include a top display portion, and it has a sloping or slanted section where input buttons are located.

In both types of gaming machines, there are commonly two drawbacks. One of them is that that once the gaming machine is manufactured, it is difficult change the configuration of the gaming machine. For example, in case when adding one more display to the gaming machine, it was necessary to remove the side panels and the front panel of the gaming machine to add one more display to the gaming machine and to replace at lease the side panels and the front panel. The other drawback is the size of the gaming machine. Particularly, in the case of slant top configuration, the depth of the gaming machine is relatively longer than that of the upright structure gaming machine. Thus, the number of gaming machines placed on the casino floor has been limited.

In order to solve the problems, U.S. Pat. No. 6,820,875 to Hedrick et al discloses a modular cabinets and replaceable laminate panel for a gaming device and a monitor cover removably connected to the display cabinet. However, it is still difficult to add an additional display device to change the configuration of the gaming machine.

Further, in recent years, flat panel display devices such as LCD (Liquid Crystal Device) panels and PDP (Plasma Display Panel) are available in a marketplace with relatively less expensive. As a result of this trend, the depth of the gaming machine has been shortened relative to the prior gaming machine based using CRT (Cathode Ray Tube).

However, prior art has not taken full advantages of these devices into the gaming machines.

An object of the present invention is to provide a gaming having a modular structure capable of being flexibly configured. The other object of the present invention is to provide a gaming machine having an ergonomic structure suitable for players of the gaming machines.

SUMMARY OF THE INVENTION

An aspect of the present invention is to provide a gaming machine including, a first cabinet including a first display for displaying a first game, a second cabinet including a second display for displaying a second game, and a third cabinet including an input device for playing the game, wherein an area of a top surface of the third cabinet is wider than an area of a bottom surface of the second cabinet or a bottom surface of the first cabinet.

In the gaming machine of described above, the depth of the top surface of the third cabinet is longer than a depth of the bottom surface of the first cabinet or the second cabinet at least by three inches.

According to an embodiment of the present invention described above, since the gaming machine is configured by a modular structure, that is, the gaming machine is configured by the first cabinet including a first display, the second cabinet including the second display and the third cabinet including the input devices, each of which has an independent modular structure, it becomes possible to swiftly configure the gaming machine required from market needs. For example, in the case when a casino operator requires a gaming machine having first cabinet and the third cabinet without having the second cabinet, it is possible to provide the gaming machine having the first cabinet and the third cabinet. Further, since the top surface of the third cabinet is larger than the bottom surface of the first cabinet, in the case when the first cabinet is placed on the third cabinet, the top surface of the third cabinet may be used as a player table for placing small personal items thereon.

Another aspect of the present invention, there is provided a gaming machines wherein a bill acceptor for inputting a bill for betting the first game or the second game is installed below the top surface of the third cabinet.

In the gaming machine described above, a printer for printing data pertaining to bet information of the first game or the second game is installed below the top surface of the third cabinet.

According to the gaming machine described above, since the bill acceptor and the printer, which have relatively long depth in size, are installed below the top surface of the third cabinet, the depth of the third cabinet is to be longer than the bottom surface of the first cabinet or the second cabinet in general. Thus, in the case when the first cabinet or the second cabinet is placed on the third cabinet, the top surface of the third cabinet may be used as a player table onto which small personal items can be placed.

In the gaming machine described above, the top surface of the third cabinet extended from the front surface of either the first cabinet or the second cabinet has a collar attached around the edge of a player side or a concave portion being lower than the top surface of the third cabinet in height.

According to the embodiment described above, since the top surface of the third cabinet has a collar attached around the edge of the player side or a concave portion of the top surface of the third cabinet, small items, for example, cups, tokens and coins can be placed on the top surface of the third cabinet, which may be used as a player table.

In the gaming machine described above, the third cabinet includes a front side surface recessed toward a rear side relative to the player, the recessed amount of the front side surface increasing toward a lower section of the front side surface.

According to the gaming machine described above, the free space for player's feet can be secured so that player can play games under a relax state.

The gaming machine further includes a fourth cabinet including a controller for controlling an operation of the gaming machine and the first game and the second game.

In the gaming machine further includes a light device for being turned on and off according to progress of the first game or the second game under the control of the controller, wherein the light device is attached at least any one of spaces formed between the first cabinet and the second cabinet, and between the second cabinet and the fourth cabinet.

In the gaming machine, the light device is placed so as to be visible at least from a front side of the gaming machine.

According to an embodiment described above, since the cabinet including the controller for controlling an operation of the gaming machine may be separately provided, the flexibility of the gaming machine configuration can be further increased. For example, in the case when two types of controllers are provided in two independent cabinets, game manufactures can provide wide range of the gaming machines by combining the controllers with the first cabinet, second cabinet and the third cabinet. Further, since the light device is mounted between the cabinets, that is, the light device is independent from the cabinet, the light device can be relatively easily and swiftly attached or detached based on the casino operator requirements, which can increase the flexibility of the gaming machine configuration.

In the gaming machine described above, data communication between the first cabinet and the controller, the second cabinet and the controller and the third cabinet and the controller is performed through a serial bus or a wireless communication device.

According to an embodiment described above, since the data communication between the controller and each cabinet is performed via a serial bus, a smaller connector and less expensive communication lines can be realized comparing with parallel transmission line, which is also help to minimize the size of the cabinet. In the case when the data communication for each cabinet is performed via a wireless communication device, since the communication line between cabinets can be omitted, the cabinet arrangement can be increased.

Another aspect of the present invention there is provided a gaming machine including, a first cabinet including a display for displaying a first game, a second cabinet including a second display for displaying a second game, and a third cabinet including a plurality of input buttons for playing the first game and the second game, an input device having an input slot and an output device having an output slot, wherein at least either the input slot or the output slot is positioned not lower than a top surface of the an input buttons located in front of the input slot in height from the bottom surface of the third cabinet.

According to an embodiment of the present invention, the slot of the input device or the output device is positioned not lower than the top surface of the input buttons located in front of the input device or the output device, the bill or the printed sheet, which is to be inputted to the input device or outputted from the output device can be inputted our outputted smoothly without interference with the input buttons.

In the gaming machine described above, at least one of the plurality of input buttons is located on a side surface of the third cabinet.

According to an embodiment described above, since one of the plurality of input buttons is located on a side surface of the third cabinet having the input device, in the case when, for example, inputting a bill for the bet of the game into the input device and starting the game by pushing the input bottom on the side plate, the operation of the game can be smoothly performed.

BRIEF DESCRIPTION OF THE INVENTION

DETAILED DESCRIPTION OF THE INVENTION

Figure 1:
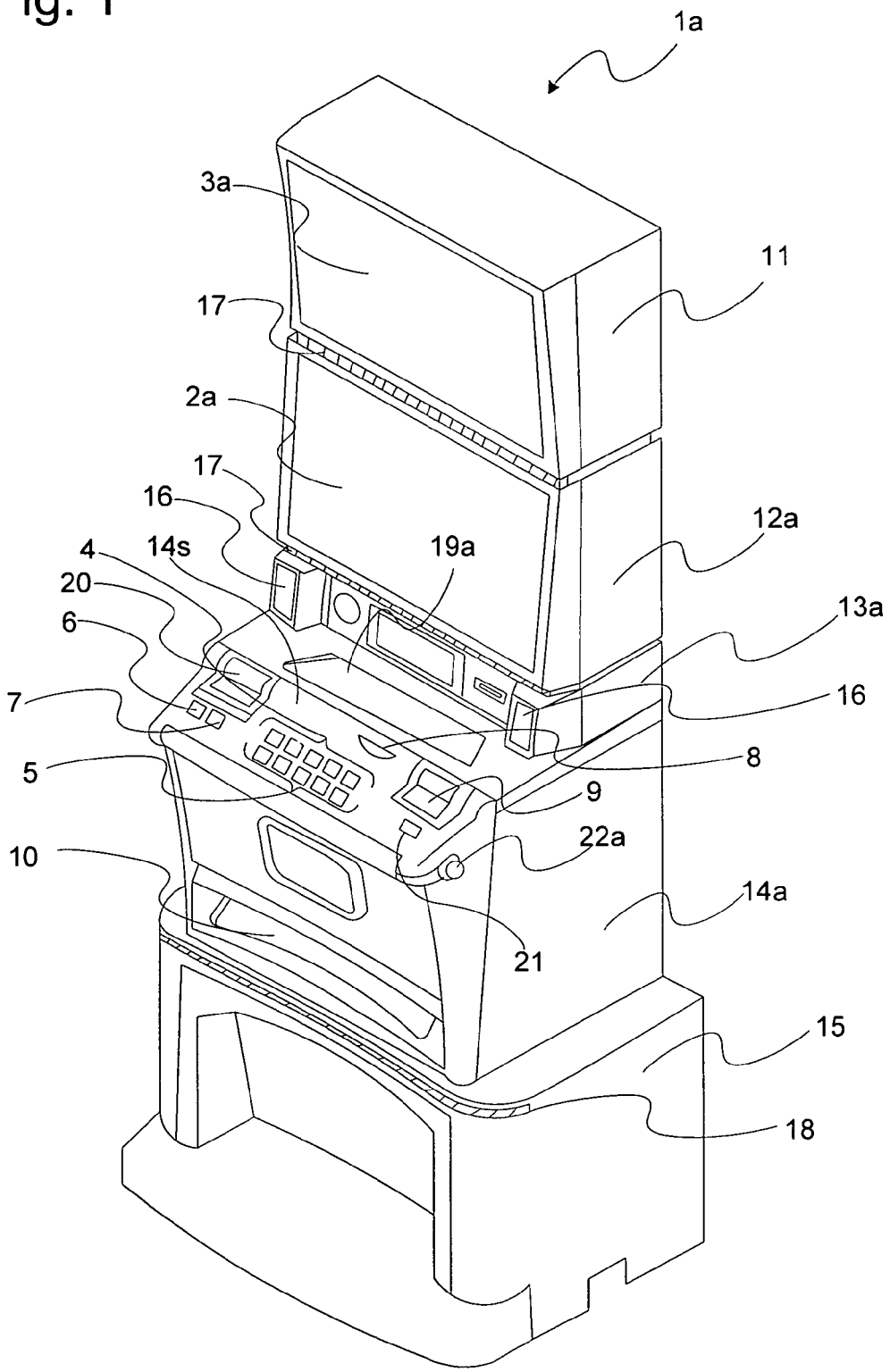
FIG. 1 illustrates a gaming machine having a modular structure for a video gaming machine of an embodiment of the present invention.

FIG. 1 illustrates a gaming machine 1*a* having a modular structure for a video gaming machine of an embodiment of the present invention. The gaming machine 1*a* is configured by a first cabinet 11 including a display 3*a;* a second cabinet 12*a* including a second display 2*b*, a third cabinet 14*a* including input devices for playing the game and a fourth cabinet 13*a* including a controller for controlling each section of the gaming machine 1*a*. The gaming machine 1*a* is generally set up on a game stand 15 depending on a situation where the gaming machine is setup.

As shown in FIG. 1, a part of the top surface of the third cabinet 14*a* facing to the player is designed to be slanted downward so that the player can easily operate input buttons and input devices for the games displayed on the first display 3*a* and/or the second display 2*b*. With respect to the input buttons, there are provided BET switches 4, selection switches 5, a MAXBET switch 6 a PAYOUT switch 7, start buttons 21 and 22*a*. With respect to the input devices, there are provided a coin slot 8 and a bill acceptor 9. The BET switches 4 include five switches from 1BET to 5BET. The selection switches 5 include five switches from 1 (one) select to 5 (five) selects of bet lines. A coin payout mouth 10 is provided in the lower part of the third cabinet 14*a*. Further, there is provided an output device, for example, a printer 20 on a slanted surface 14*s* of the third cabinet for outputting printed material pertaining to the game of the gaming machine 1*a*.

The instruction for performing a primary game or a secondary game is normally displayed on the first displays 3*a*. Cards used by a card game, roulette used in a roulette game and reels used in a reel game are displayed on the second displays 2*a*, for example.

The BET switches 4 are switches for inputting a bet on the game. The player can input a bet from 1BET to 5BET using the BET switches 4 one time for a game. A selection switch 5 is a switch for, for example, selecting a line on the reels and the card, which the player wants to set on the games.

The MAXBET switch 6 is a switch for inputting the maximum bet that a player can spend against one time of a game. A PAYOUT switch 7 is a switch for rewarding the amount of money to a player, which has been credited onto the gaming machine. The start buttons 21 and 22*a* are buttons for starting game. The starting buttons 21 and 22*a* may be arranged on the slanted surface 14*s* of the third cabinet and sidewall of the third cabinet so that the player can select the starting button for his or her preference in this embodiment. A coin slot 8 is a hole for a player to insert the coin to the gaming machine. A bill acceptor 9 is a input and output device to be used in order to feed a bill or a cash card into the gaming machine, or in order to repay the amount of money, which has been credited. The coin tray mouth 10 is a tray in to reward the amount of money to a player, which has been credited in the gaming machine.

Figure 3:
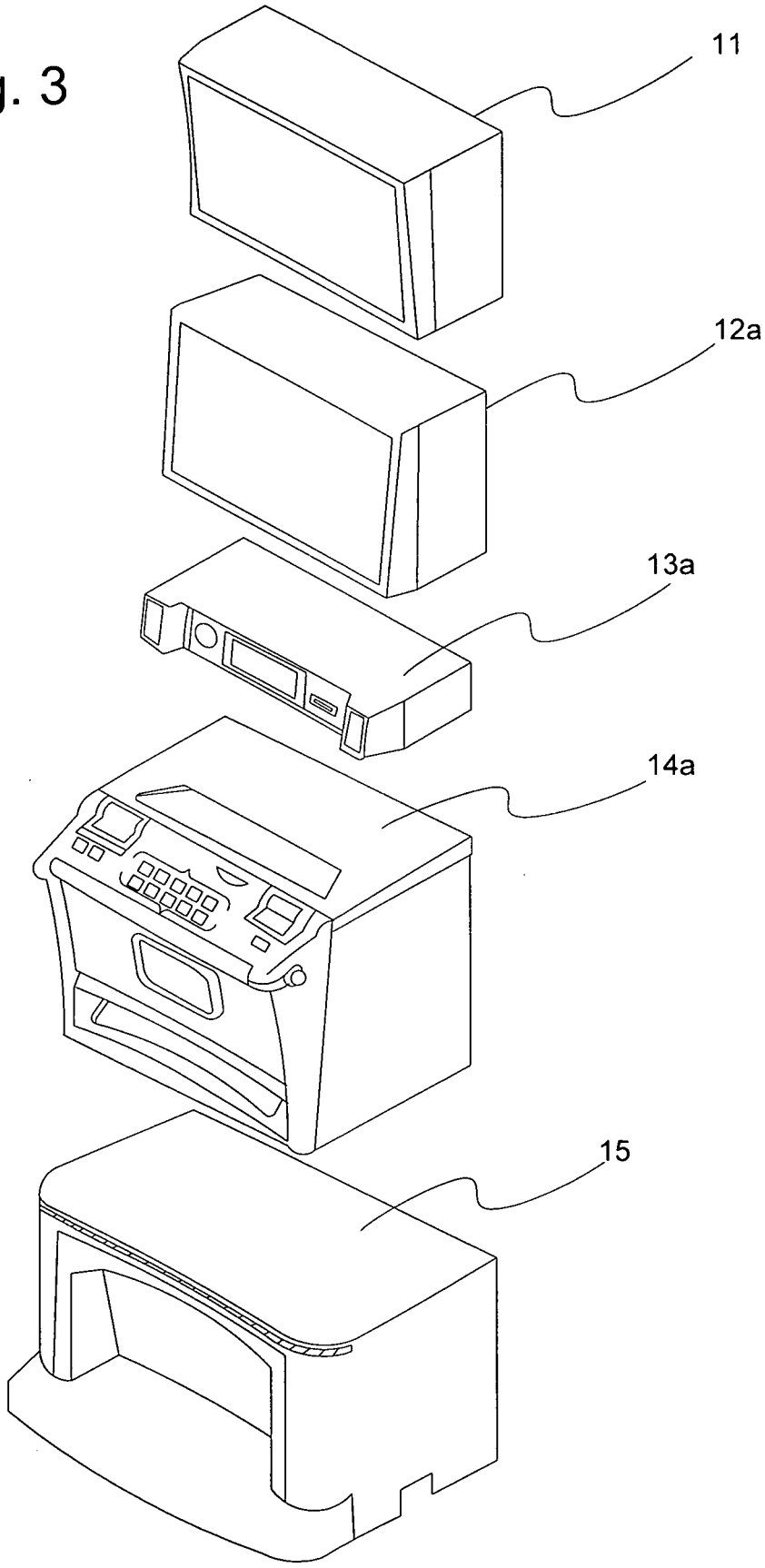
FIG. 3 illustrates a modular structure for the video gaming machine of an embodiment of the present invention.

As shown in FIGS. 1 and 3, the gaming machine 1 is configured by independent cabinets, such as the first cabinet 11 including the first display 3*a*, the second cabinet 12*a* including the second display 2*a*, the third cabinet 14*a* including the input device and the output device for playing the game and the fourth cabinet 13*a* including the controller for controlling games displayed on the first and the second displays 3*a* and 2*a*, the input buttons and input devices as described above, speakers 16 and light devices 17, which are synchronized with the game played on the gaming machine 1*a*. According to one of embodiments of the present invention, the controller for controlling an operation of each function of the gaming machine may be included in the third cabinet together with the input and out devices so that fourth cabinet may be omitted. However, in this case, speakers 16 provided in the fourth cabinet needs to be installed into other cabinets for example, the first cabinet, the second cabinet and/or third cabinet.

As shown in FIG. 1, since the gaming machine is structured by the first cabinet, the second cabinet, the third cabinet and the fourth cabinet, it is easy to change the configuration of the gaming machine. For example, in the case where the gaming machine including the first display and the second display has been installed on the casino floor and later new games, which need only one display, have been installed into the gaming machine, it is easy to change the configuration of the gaming machine by removing the first cabinet from the gaming machine without changing the whole gaming machine by utilizing the advantages of the modular structure of the gaming machine.

The other advantage of the modular structure of the gaming machine is that gaming machine manufactures can respond a plurality of requirements for the gaming machine configurations by providing necessary types of modular cabinets without providing necessary types of whole gaming machines. Thus the gaming machine manufactures can reduce the inventory cost and quickly respond the markets needs by configuring the gaming machines by using necessary modular cabinets.

By taking these advantages of the modular structure of an embodiment of the present invention, it becomes possible to quickly respond the different kinds of needs of gaming machine configurations using predetermined modular cabinets. For example, in the case where one casino operator requires a gaming machine having only one display and the other operators require a gaming machine having two displays with light devices between the first cabinet and the second cabinet and the between the second cabinet and the fourth cabinet, according to an embodiment of the present invention, it becomes possible to supply gaming machines to both casino operators by selecting necessary number of displays to configure the requested gaming machine having necessary light device requirements to respective casino operators without having two types of whole gaming machines. However, in the case of the gaming machine structure of the prior art described above, in order to satisfy various kinds of customer requirements, it is necessary to provide various types of gaming machines for respective casino operators in advance. In practice, when there is a plurality of potential casino operators for the gaming machines, in general, each casino operator has different kinds of configurations of the gaming machines. Thus, this modular cabinet configuration is effective to respond those needs in a timely manner.

Figure 6:
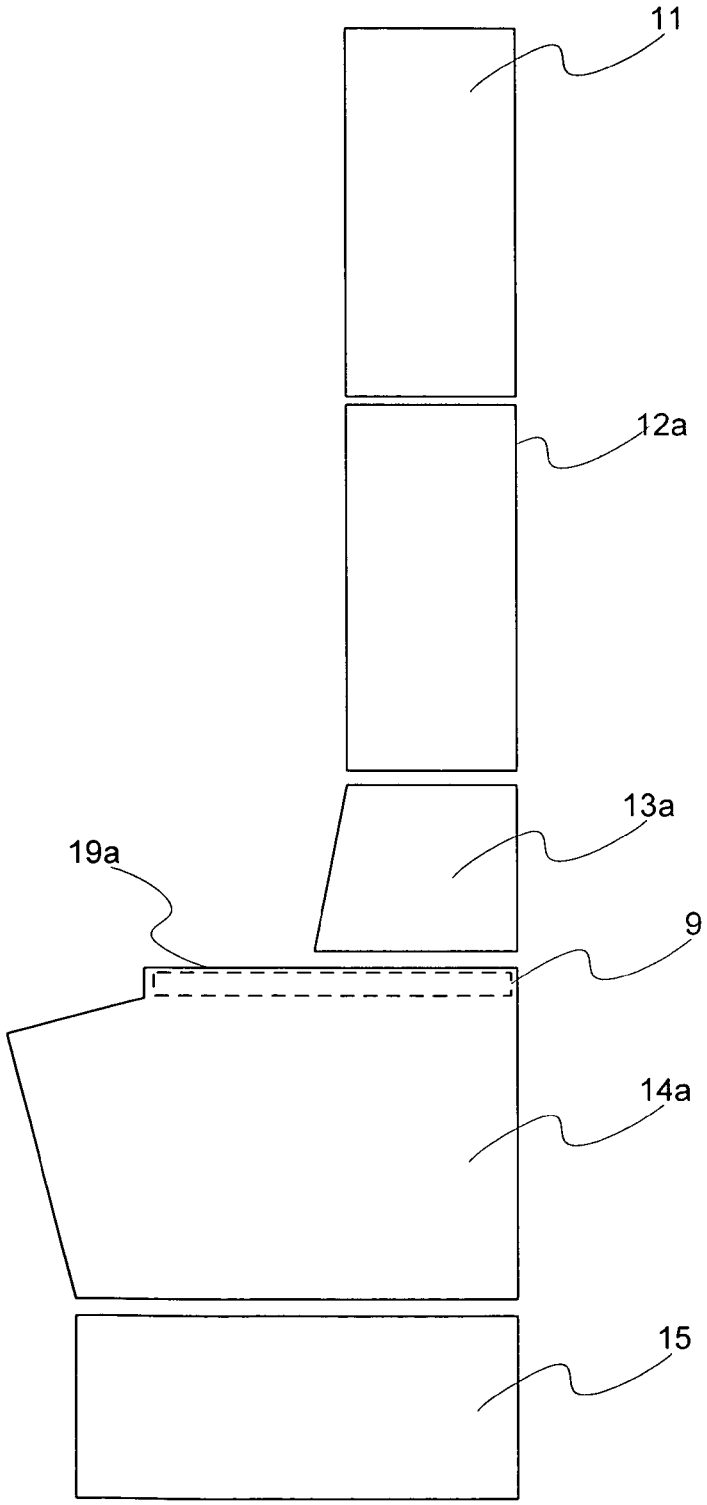
FIG. 6 illustrates a side view of a gaming machine having a third cabinet into which a bill acceptor is horizontally installed below the top surface of the fourth cabinet.
Figure 7:
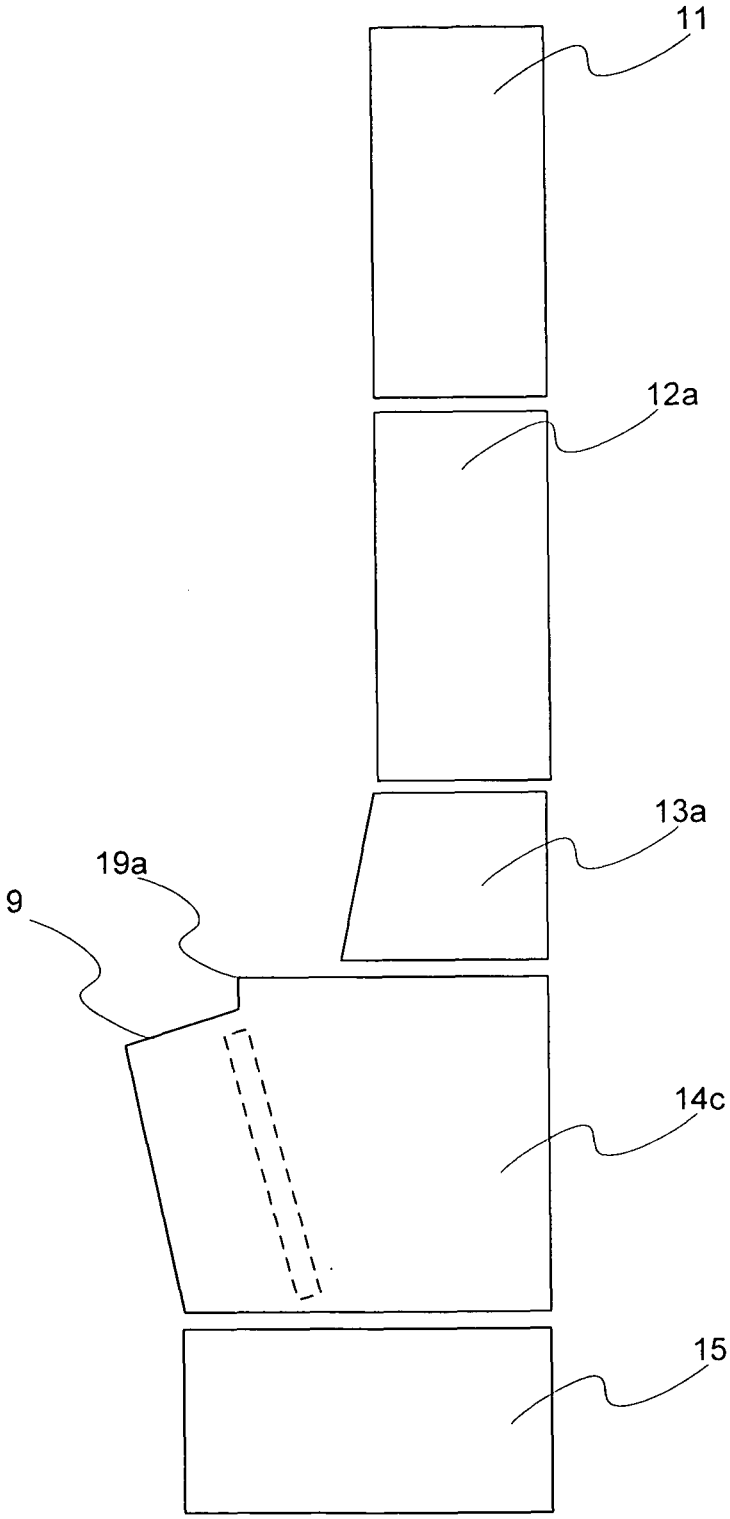
FIG. 7 illustrates a side view of a gaming machine having a third cabinet into which a bill acceptor is obliquely installed below the top surface of the fourth cabinet.

Next, the depth of the gaming machine and a player table provided on the top surface of the third cabinet will be described. In the case where there are provided two types of third cabinets 14*a* and 14*c* having different depth (the length from the front surface to the rear surface of the third cabinets 14*a* and. 14*c*) depending on the location where the bill acceptor 9 is installed inside the third cabinets 14*a* and 14*c* as shown in FIGS. 6 and 7, two types of gaming machines can be provided by preparing two types of third cabinets 14*a* and 14*c* while commonly using the first cabinet 11, the second cabinet 12*a* and the forth cabinet 13*a* for both gaming machines illustrated in FIGS. 6 and 7. Thus by utilizing the modular cabinet structure, since the gaming machine manufactures can only preparing cabinets having different functions and or dimension, it becomes possible to manufacture the gaming machines with less expensive operation cost comparing with the manufacturing cost of the gaming machines based on the prior art described above.

As illustrated in FIG. 6, the bill acceptor 9 and the printer 20 (referring to FIG. 1) have a relatively long depth among the parts used in the gaming machine. In the gaming machine illustrated in FIG. 6, the bill acceptor 9 is horizontally installed below the top surface of the third cabinet 14*a*. On the other hand, as illustrated in FIG. 7, the bill acceptor 9 is obliquely installed below the top surface of the third cabinet 14*c* so that the depth of the third cabinet 14*c* can be structured shorter than that of the third cabinet 14*a* as illustrated in FIG. 6. Based on these arrangements of the location of the bill acceptor 9 inside the fourth cabinets 14*a* and 14*c*, two types of third cabinets 14*a* and 14*c* having different depths can be provided, for example.

In the case of the third cabinet 14*a* into which the bill acceptor 9 is horizontally installed as illustrated in FIG. 6 the player table 19*a* has a relatively wider area comparing with the area of the player table 19*c* of the third cabinet 14*c* illustrated in FIG. 7 when the same fourth cabinet 13*a* is placed on the top of the third cabinet.

On the other hand, since the total depth of the gaming machine using the third cabinet 14*c* illustrated in FIG. 7 can be shorter than that of the gaming machine using the third cabinet 14*a* illustrated in FIG. 6, more gaming machines using the third cabinet 14*c* can be placed on the same casino floor space than the gaming machine using the third cabinet 14*a* illustrated in FIG. 6.

Thus, it is possible to promptly respond wide range of requirements from casino operators by providing the different types of third cabinets having different depth using different kinds of installation position of the bill acceptor 9 in the third cabinet. Needless to say, as described above, the printer 20 installed inside the third cabinet is also one of the critical elements when designing the third cabinet. In this embodiment, the depth of the gaming machine has been described. However, it is not limited to the depth of the gaming machine. For, example, it is possible to prepare different types of input key layout, color of the modular cabinets of the gaming machine and different types of functionality of the gaming machines.

Figure 2:
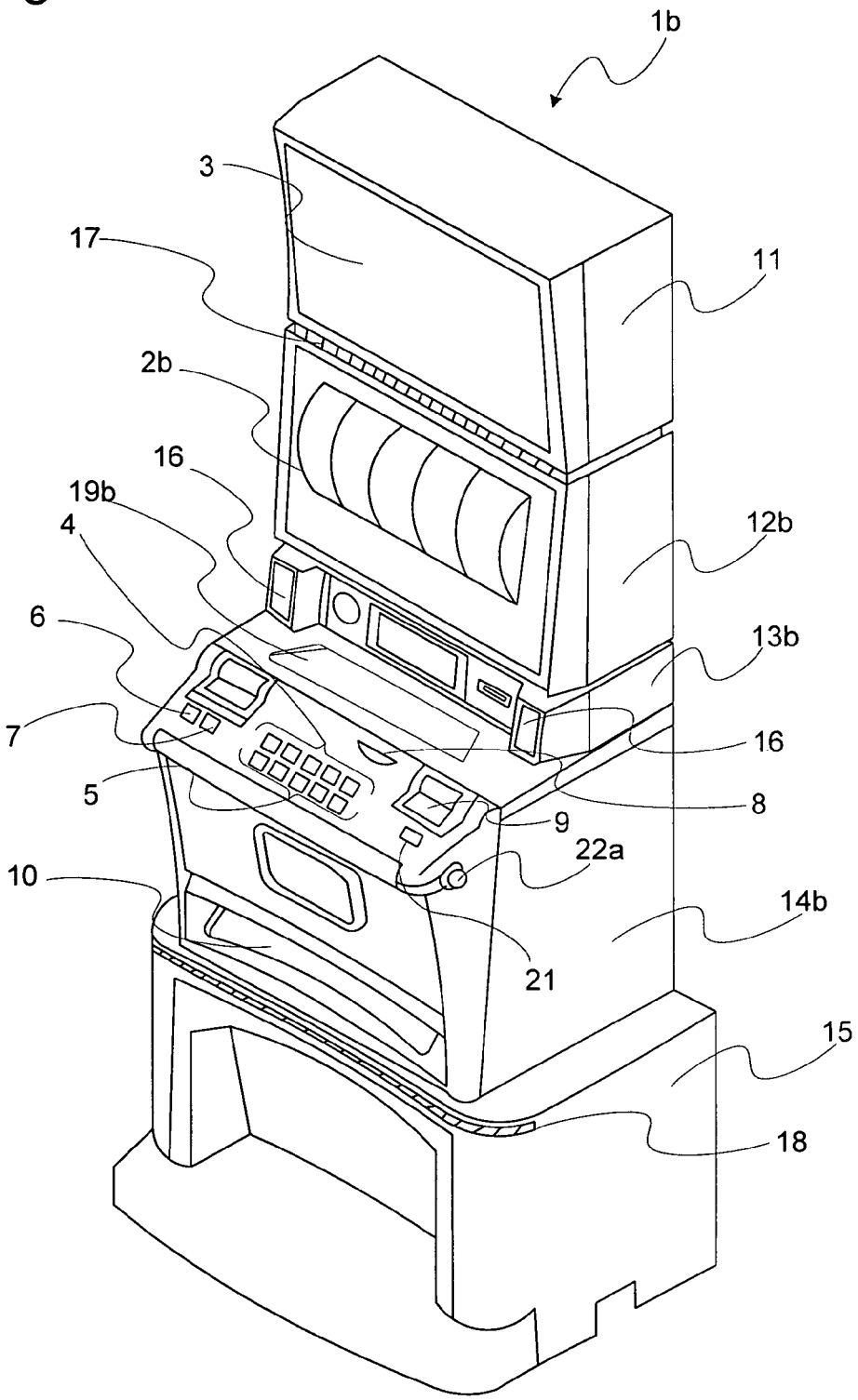
FIG. 2 illustrates a gaming machine having a modular structure for mechanical reels (steppers) of an embodiment of the present invention.

FIG. 2 illustrates a gaming machine having a modular structure for mechanical reels (stepper) of an embodiment of the present invention. As shown in FIG. 2, the second cabinet 12*b* includes a mechanical reels (stepper) 2*b* instead of the second display 2*a* in FIG. 1. In this embodiment, five mechanical reels are installed into the second cabinet 12*b*. In this embodiment, the fourth cabinet 13*b* including a controller having functions for controlling not only mechanical reels but also for controlling games displayed on the first displays 3*a*, the input devices as described above and lamps and speakers associated with the game. Also, it is possible to provide a controller for controlling, the first display 3*a*, the second display 2*a*, the mechanical reels 2*b* and the input devices so that one type of controller can be utilized for different kinds of gaming machines. Further, the same as described above, it is also possible that the controller may be included in the third cabinet together with the input devices so that fourth cabinet may be omitted.

Figure 4:
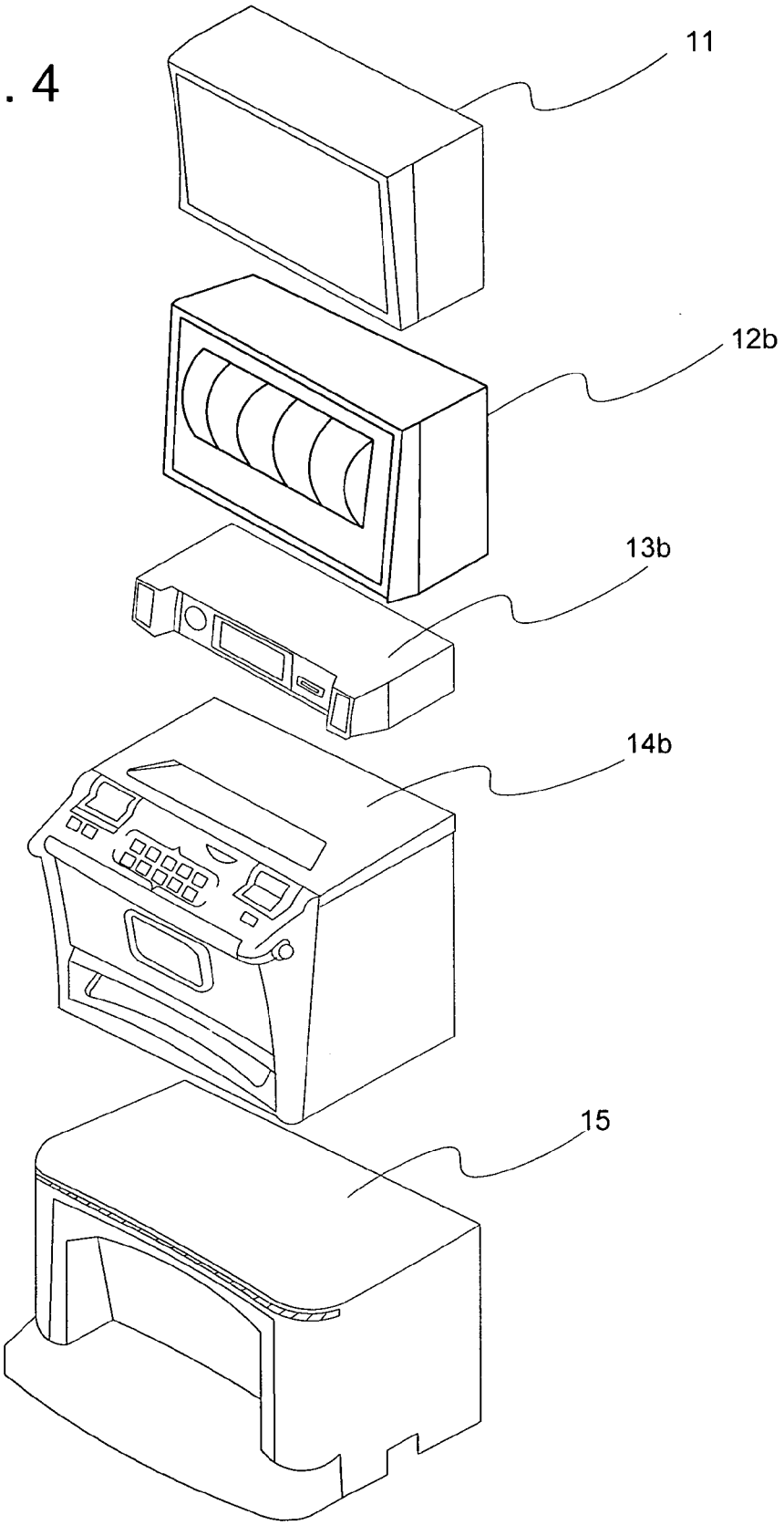
FIG. 4 illustrates a modular structure of the gaming machine having mechanical reels (steppers) of an embodiment of the present invention.

FIG. 4 illustrates a modular structure of the gaming machine having mechanical reels (stepper) of an embodiment of the present invention. As illustrated in FIGS. 3 and 4, the areas of the top surfaces (horizontal portion) of the third cabinets 14*a* and 14*b* are designed to be wider than the bottom surface of the fourth cabinet 13*b*, the second cabinets 12*a* and 12*b* and the first cabinet 11 so that a part of the top surface can be used as a player table or a player shelf, which will be described later.

Figure 5:
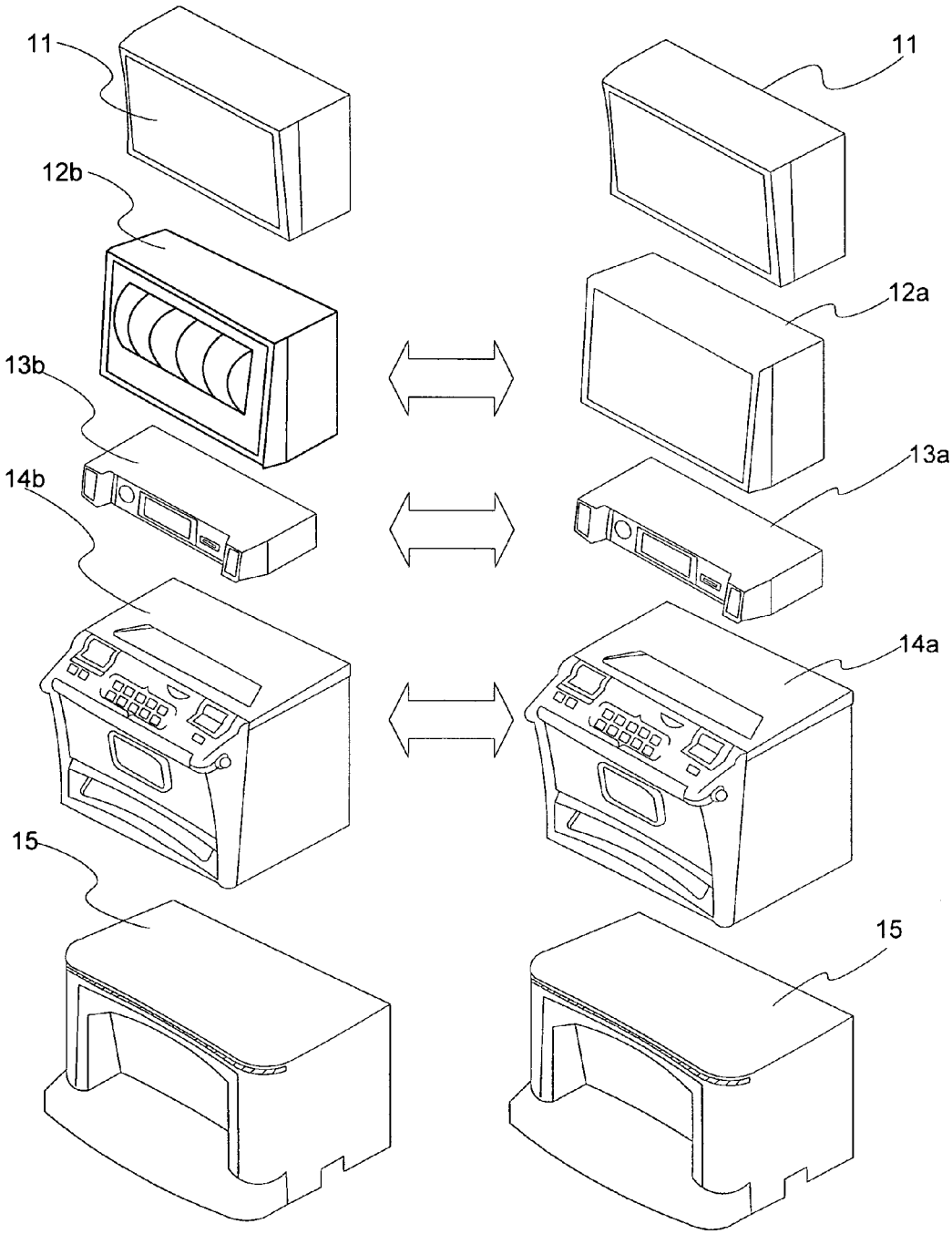
FIG. 5 illustrates the interchangeability between the modular cabinets of the video gaming machine and the mechanical slot (stepper) machine of embodiments of the present invention.

FIG. 5 illustrates the interchangeability between the video gaming machine 1*a* illustrated in FIGS. 1 and 3 and the gaming machine 1*b* having mechanical reels (stepper) illustrated in FIGS. 2 and 4 of embodiments of the present invention. In the case where the second cabinets 12*a* and 12*b*, the third cabinets 14*a* and 14*b* and the fourth cabinets 13*a* and 13*b* are designed to interchangeable even though the mechanical dimensions and functions are different each other, total eight type of combination will be available. Thus various kinds of requirements from market needs can be quickly responded by combining the necessary cabinets based on the requirements.

Next, the player table will be described. In FIG. 1, input buttons, such as the BET switches 4, selection switches 5, the MAXBET switch 6 and the PAYOUT switch 7 are provided on the slant surface 14*s* of the third cabinet. Further, a player table or a player shelf 19*a* onto which a player can place small items, such as a cup for drinks, coins and tokens is provided in front of the cabinet 2 and/or the fourth cabinet 13*a* in this embodiment.

Figure 8:
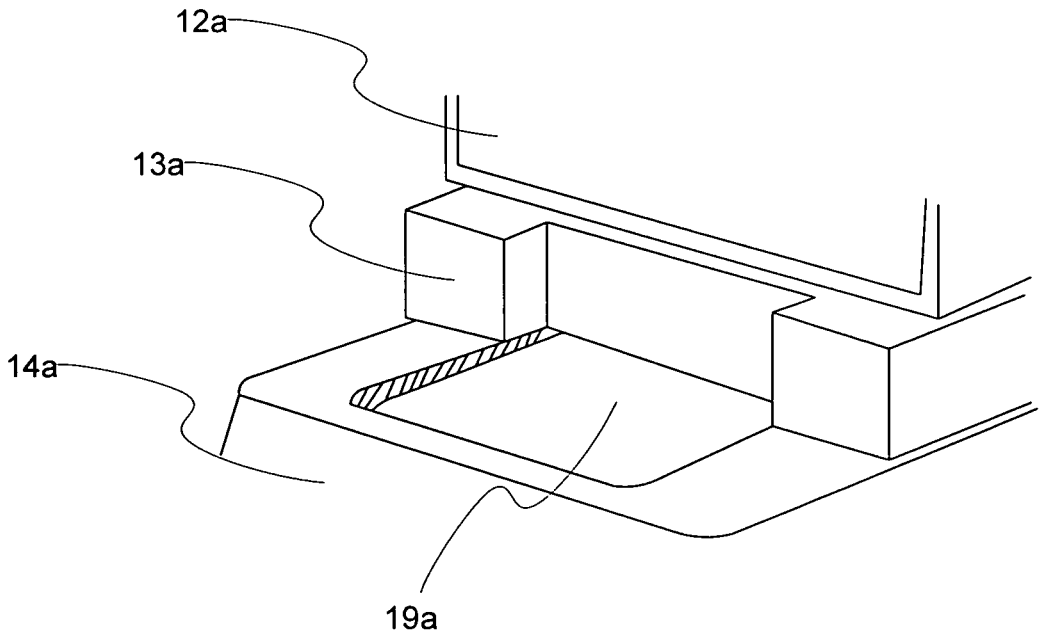
FIG. 8 illustrates a player table having a concave structure of the top surface of the third cabinet, the player table extending toward a player side of the gaming machine illustrated in FIG. 1.

FIG. 8 illustrates one of example of a player table or a player shelf 19*a* having a concave structure of the top surface of the third cabinet 14*a* extending toward the player side of the gaming machine of one embodiment of the present invention. The concave structure is designed to have a bottom surface, which is lower than the top surface of the third cabinet 14*a* in height.

Figure 9:
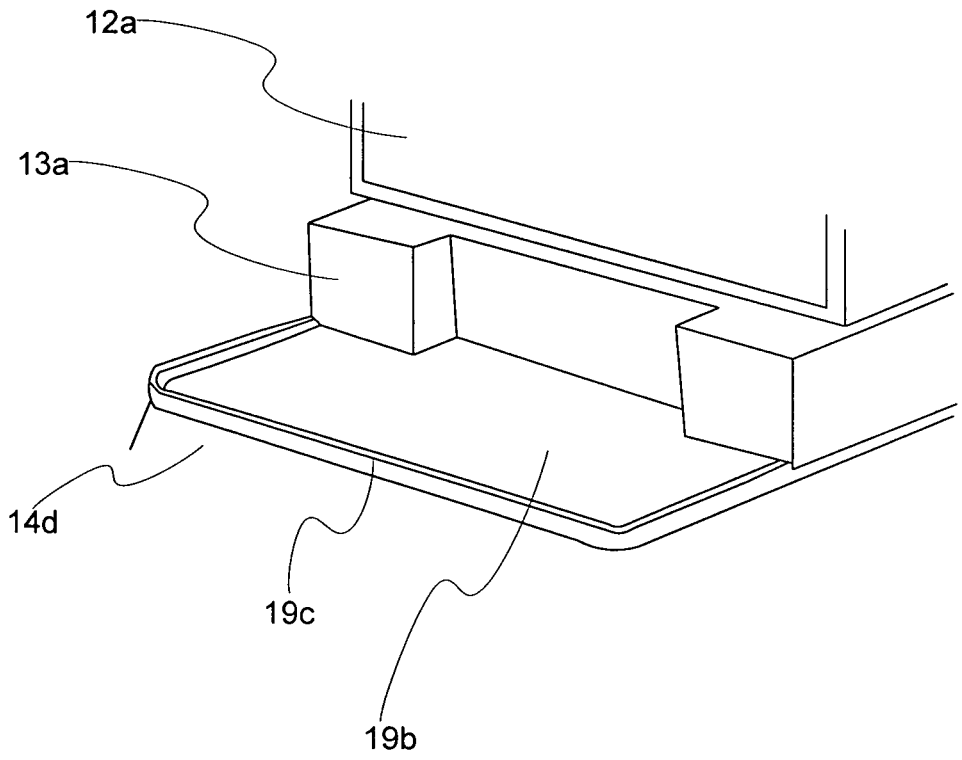
FIG. 9 illustrates a player table having a collar attached around the edge the top surface of the fourth cabinet, the player table extending toward a player side of the gaming machine illustrated in FIG. 1.

FIG. 9 illustrates the other example of a player table or a player shelf 19*b* having a collar 19*c* attached around the edge the top surface of the third cabinet 14*d* of an embodiment of the present invention. According to these structures described above, small items, which player can put thereon, can be prevented from sliding down from the player table or the player shelf.

Further, according to an embodiment of the present invention, the depth of the top surface of the third cabinet is preferably designed to be longer than the depth of the bottom surface of the first cabinet 11, the second cabinet 12*a* and the fourth cabinet 13*a* at least by 3 inches so that a mug cup and/or other personal items of the player can be placed thereon, which is convenient for the players of the gaming machine.

The area on the top surface of the third cabinet 14*a*, which is utilized for the player table 19*a*, can be secured by installing the bill acceptor 9 and the printer 20, which have relatively long depth among the parts used in the gaming machine 1, under the top surface of the third cabinet 14*a* or the player table 19*a*. In this embodiment, the bill acceptor 9 and the printer 20 are used as the input device and the output device respectively. However, the input device and the output device are not limited to the bill acceptor 9 and the printer 20. For example, a card reader, which is capable of magnetically or optically reading data from a card type medium such as a magnetic card or an optical card including a cash card, and a card reader/writer, which is capable of reading/writing data from/onto a card type medium, such as a contact smart card and a non-contact smart card being a smart card, a debit card and a point card for the game machine may also be used as an input device and or an output device.

Further as illustrated in FIGS. 1-7, the third cabinets 14*a*, 14*b* and 14*c* including the input devices includes a front side surface recessed toward a rear side relative to the player, a recessed amount of the front side surface increasing toward a lower section of the front side surface. Accordingly, the player of the gaming machines described above can freely move their feet when sitting down on the chair provided in front of the gaming machines.

Next, light effects and sound effects in the gaming machine associated with the modular structure will be described hereinafter. In general, the light effects and the sound effects of the gaming machine are important factors to attract players to casino floor. The light device 17 is placed between the first cabinet 11 and the second cabinet 12*a* and between the second cabinet 12*a* and the fourth cabinet 13*a* including the controller. Further, the light device 18 is mounted on the upper-front portion of the game stand 15 in this embodiment. The light device 18 attached in the game stand 15 may be mounted between the third cabinet 14*a* and the game stand 15. The light devices 17 and 18 are structured as following. A plurality of light elements is mounted on the bracket which is designed to fit the space formed between the modular cabinets when the modular cabinet is placed on the other modular cabinet. Since the bracket of the light device fit the space formed between the modular cabinets, it is possible to attach or detach the light devices onto or from the gaming machine having modular structure illustrated in FIG. 1. These light devices 17 and 18 are electrically connected to the controller in the third cabinet 13*a* so that the lights emitted from the light devices 17 and 18 can be synchronized with the progress of the games. For example, when the big win is established in the game, the light devices 17 and 18 turn of and off (blinking) and game sound comes out from the speakers 16 provided in the fourth cabinet in this embodiment.

The light devices 17 and 18 are designed to fit the spaces between respective cabinets so that it becomes easy to attach those light devices 17 and 18 according to the configuration requirement from casino operators of the gaming machines even after having set the gaming machines on the casino floors Further, in the case when the gaming machine, which is configured by the second display 12*a*, the third cabinet 14*a*, the fourth cabinet 13*a* and the fifth cabinet 15, is provided, the light device 17 may be placed, between the second cabinet 12*a* and the fourth cabinet 13*a* and between third cabinet 14*a* and the game stand 15 even after having set up these gaming machine on the casino floor.

Since the respective cabinets are designed to have the same space formed by respective cabinets when those cabinets are configured into a vertical direction, one standard size of light device can be placed and attached for each space between the cabinets. Since one type of light device in terms of the size, which can be placed and attached onto the gaming machine, the manufacturing cost of these light devices can be lowered. The light devices are formed, in general, by LED (Light Emitted Diode) devices having various kinds of colors associated with the situation of the game story. Needle to say, the light devices having different color arrangement can further widen the selections of the gaming machines.

Figure 12:
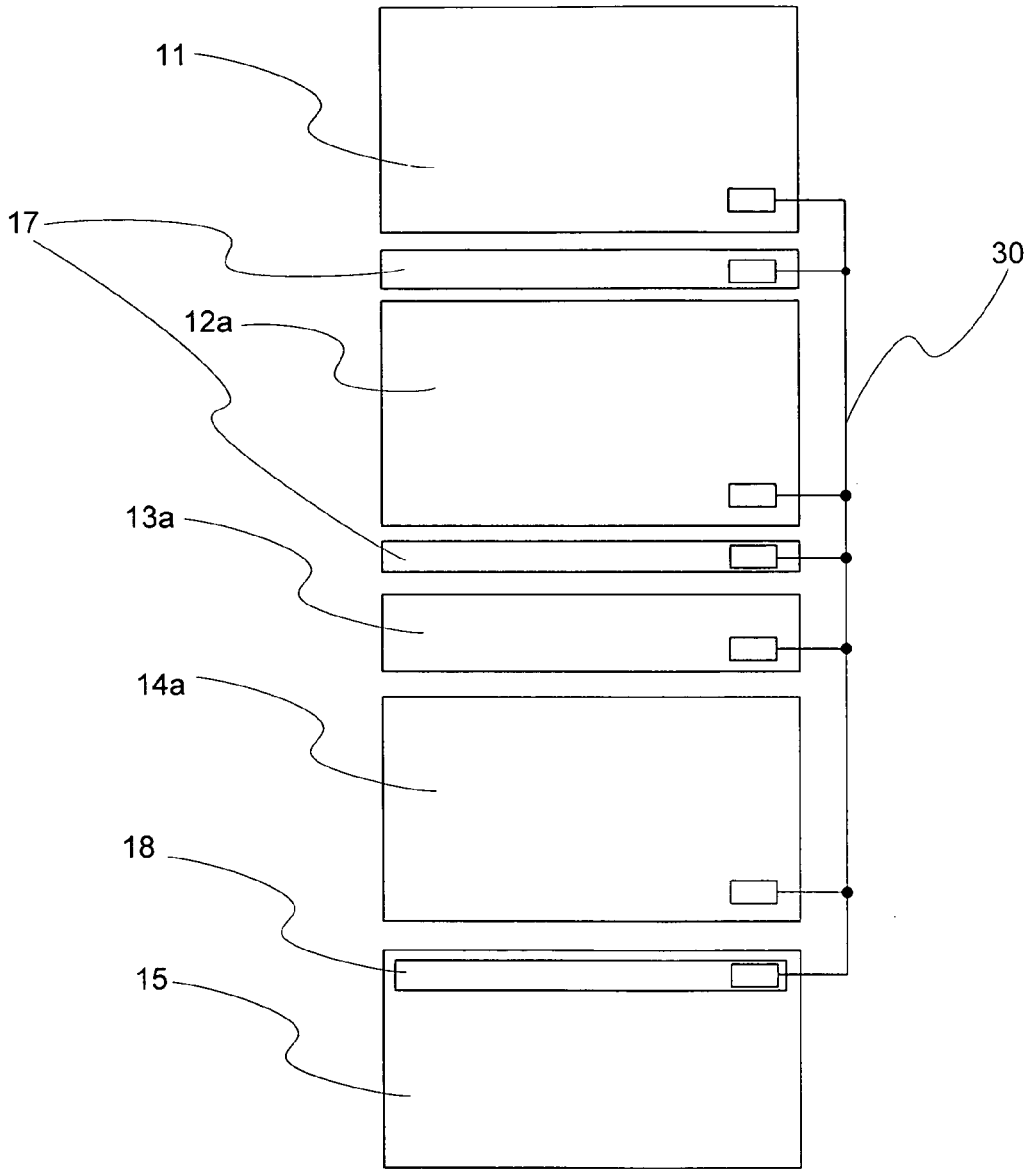
FIG. 12 illustrates a circuit diagram showing electrical connection between lamps and cabinets of gaming machine.

FIG. 12 illustrates a circuit diagram showing electrical connection between cabinets and light devices placed between the cabinets configuring a gaming machine. In this embodiment, the light devices 17 are placed between the first cabinet 11 and the second cabinet 12*a*, and between the second cabinet 12*a* and the fourth cabinet 13*a*. Further, the light device 18 is mounted in the game stand 15. Respective cabinets and light devices have a serial data interface, such as USB (Universal Serial Bus) and through which the controller inside the fourth cabinet 13*a* controls the operations of the game functions performed by each cabinet and light device. Since, control data communicated between respective cabinets and light devices is transmitted via serial data line, the diameter of the data line and the size of the connecters on each cabinet can be small, and the size of the connector of each cabinet and the light device can also be minimized.

Next, the arrangement of the input buttons 21 located in front of the bill acceptor 9 will be described from the view point of ergonomic design of gaming machine of the embodiment described above. This arrangement may also be applicable to the arrangement of the MAXBET switch 6 for inputting the maximum bet that a player can spend against one time of a game and the PAYOUT switch 7, which are located in front of the printer 20 provided on the slanted surface 14*s* of the third cabinet 14*a*.

Figure 10:
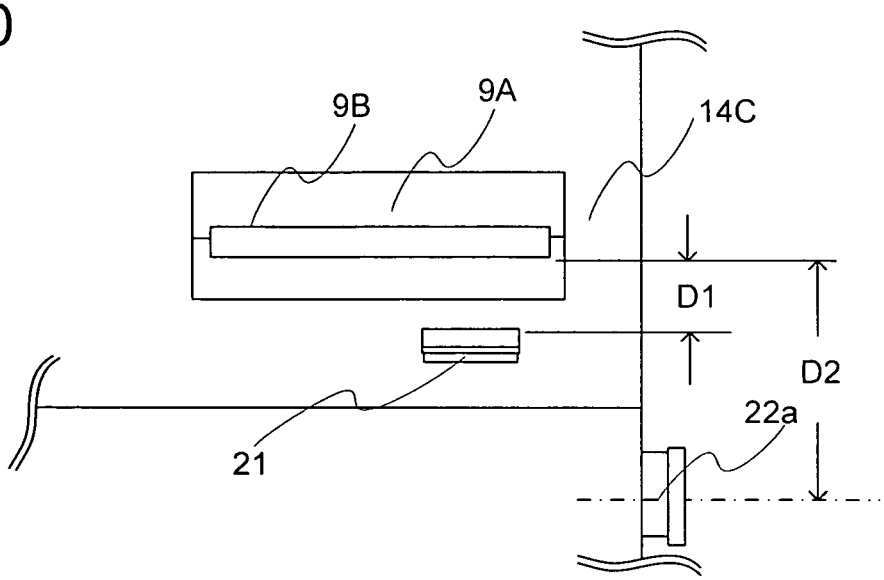
FIG. 10 illustrates relationship between the input slot of a bill acceptor and input buttons located in front of the bill acceptor viewed from the in front of the gaming machine.
Figure 11:
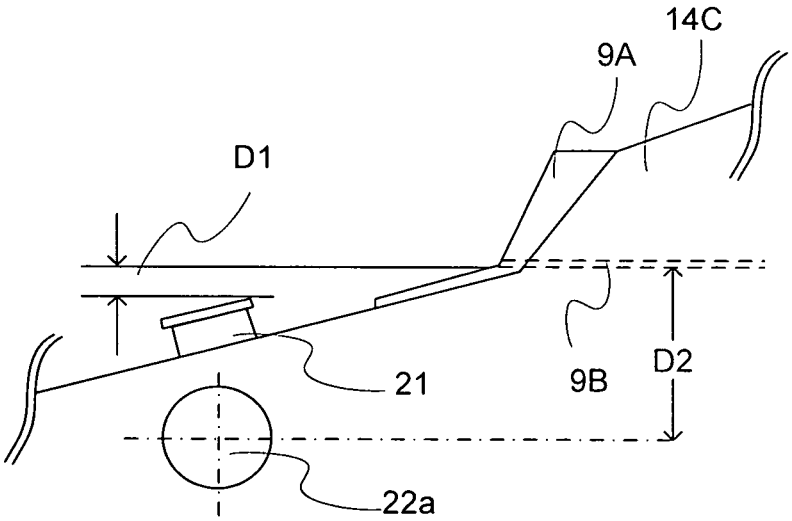
FIG. 11 illustrates relationship between the input slot of the bill acceptor and input buttons located in front of the bill acceptor viewed from the side of the gaming machine.

FIG. 10 illustrates the relationship between the input slot 9B of the bill acceptor 9 and the input buttons 21 located in front of the bill acceptor 9 viewed from in front of the gaming machine 1*a* and the starting button 22*a* positioned on the side surface of the third cabinet 14*a*. FIG. 11 illustrates relationship between the slot 9B of the bill acceptor 9 and the input buttons 21 located in front of the bill acceptor 9 and the starting button 22*a* positioned on the side surface of the third cabinet 14*a* viewed from the side of the gaming machine 1.

In this embodiment, as illustrated in FIG. 10, the top surface of the input buttons 21 is positioned not higher than the height of the input slot 9B of the bill acceptor 9. According to this embodiment, the bill can be smoothly inputted to the input slot 9B of the bill acceptor 9. It is preferable that the distance D1 between the top surface of the input button 21 and the input slot 9B of the bill acceptor 9 is set from ¼ inches to 1 inch (6 mm-25.4 mm). In case when the top surface of the input switch 21 is higher than the input slot 9B, the input button 21 will interfere the bill to be inserted to the input slot 9B. In the case when the input button 21 is away from the input slot 9B, the operation flow from the insertion operation bill to start game cannot be smoothly performed.

In the case where the bill acceptor 9 is obliquely installed in the third cabinet as shown in FIG. 7, since bills or cards can be obliquely inputted to the input slot 9B, the distance (D1 in FIGS. 10 and 11) between the top surface of the input button 21 and the input slot 9B of the bill acceptor may be set from 0 to 1 inch (0 mm-25.4 mm).

Further, a start button 22*a* for starting a game may be provided on the sidewall of the third cabinet as shown in FIGS. 10 and 11. In general, the player tends to put his or her hand on the corner formed by the slant surface 14*s* and the sidewall of the third cabinet 14*a*. Further, before staring the game, the player normally input bills or a game card to the slot of the input device by their right hand, then starting the game by pushing the start button. Thus the position of the staring button 22A is one of the key factors for determining the smooth operation of the gaming machine. Thus the starting button 22A for starting a game is positioned close to the input slot 9B of the input device 9.

In this embodiment, the start key may be set in front of the input slot 9B of the bill acceptor 9 or the sidewall of the third cabinet 14*c*. In the case where the start button 22A is positioned on the sidewall of the third cabinet 14*c*, the center of the start button 22A is positioned in a distance (D2 in FIGS. 10 and 11) from ¾ inches to 7 inches (20 mm to 180 mm) lower than the slot of the input device 9. As described above, in the case where the start button 22A is away from the input slot 9B of the bill acceptor 9, the operation flow from the insertion operation bill to start game cannot be smoothly performed.

Next, the total operations of the gaming machine will be described by using the block diagram of the gaming machine 1*a* illustrated in FIG. 13.

Figure 13:
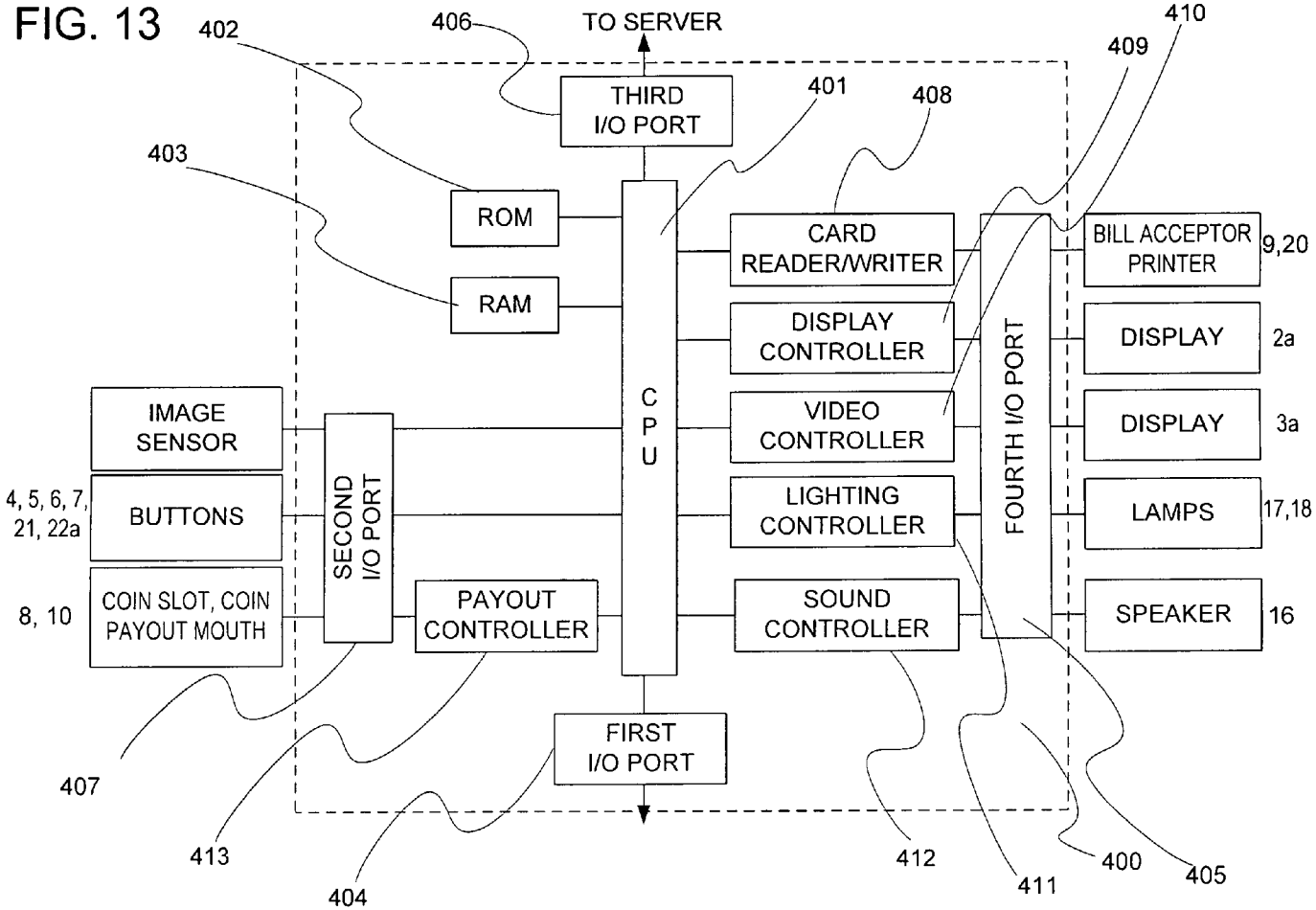
FIG. 13 illustrates a block diagram of an embodiment of the present invention.

FIG. 13 illustrates a block diagram of an embodiment of the present invention. As shown in FIG. 13, the main control board (controller) 400 includes a main CPU 401, a first I/O port 404, a second I/O port 407, a third I/O port 406, a fourth I/O port 405, a ROM 402, a RAM 403, a video controller 410, a lighting controller 411, a sound controller 412, a payout controller 413, a card reader/writer 408*a* and a display controller 409.

The first I/O port 404*a* is used in communication between the main control board 400 and the sub-control board (not shown). The second I/O port 407 is used in communication between the main control board 400 and the coin slot 8, the coin payout mouth 10 and input buttons 4, 5, 6, 7, 21 and 22*a*. The third I/O port 406 is used in communication between the main control board 400 and a server (not shown) through the communications network. The fourth I/O port 405 is used in communication between the main control board 400 and the bill acceptor 9, the printer 20, displays 2*a* and 3*a*, the light devices 17 and 18 and speakers 16.

The ROM 402 stores various programs, e.g., a communications program and various gaming programs. The main CPU 401 invokes the programs for games performed on the gaming machine 1*a*.

The RAM 403 temporally stores results computed by the CPU 401. The video controller 410 controls the display on the displays 2*a* and 3*a* under control of the CPU 401. The lighting controller 411 switches the lamps 17 and 18 on and off under control of the CPU 401.

The sound controller 412 controls the speakers 16 to reproduce voice announcements, sound effects, and the like under control of the CPU 401.

The payout controller 413 controls the coin payout mouth 10 to supply a proper amount of coins under control of the CPU 401.

The card reader/writer 408 reads and writes data from and onto the card inserted in the in the printer 20 under control of the CPU 401. Also, the card reader/writer 408 controls the count of number of bills inserted from the bill acceptor 9 under the control of the CPU 401.

The CPU 401 is connected to the input buttons 4, 5, 6, 7, 21 and the start button 22*a*, the MAXBET switch 6 and the PAYOUT switch 7, and transmits operation signals through the second I/O port 407.

Moreover, the CPU 401 is also connected to a coin counter (not shown in figures) that counts the amount of cash inserted into the coin slot 8.

The block diagram illustrated in FIG. 13 describes the functions of each section of the gaming machine 1*a* illustrated in FIG. 1. In the case of the gaming machine 1*b* having a mechanical reels 2*b*, the control programs for the mechanical reels 2*b* is stored in the ROM 402 and the mechanical reels 2*b* connected to the control board 400 instead of the display 2*a* will be controlled by the CPU 401. As described previously, the control programs for the mechanical reels 2*b* will be able to be installed together with the control programs for the display 2*a* into the ROM 402 so that one controller can be used not only gaming machine 1*a* but also the gaming machine 1*b*.

The present invention is not limited to the above embodiments and various changes and modification may be made without departing from the scope of the invention. For example, in this embodiment, the controller is installed inside the forth cabinet. However, the controller may be installed in the third cabinet, or may be installed in either the first cabinet or the second cabinet. Further, in this embodiment, the data is transmitted via a serial transmission line, such as USB. However, the data transmission may be performed via a cordless communication devices installed each cabinet so that the transmission line can be omitted.

What is claimed is:

1. A gaming machine cabinet kit, comprising:

a first cabinet including a first display for playing a first game, the first cabinet including the first display can be replaced by the first cabinet including a third display;

a second cabinet including a second display for displaying a second game; and a third cabinet including an input device for playing the first game and the second game, a fourth cabinet including a controller for controlling at least the first display and the third display, the fourth cabinet being placed between the second and the third cabinet wherein an area of a top surface of the third cabinet is greater than an area of a bottom surface of the second cabinet, a bottom surface of the first cabinet including the third display, and a bottom surface of the first cabinet including the first display, wherein each of the first cabinet including the first display, the first cabinet including the third display, the second cabinet, and the third cabinet has a mechanically independent modular structure being mechanically separable from each other, and wherein the top surface of the third cabinet protrudes at least three inches horizontally beyond the bottom surface of the second cabinet.

2. The gaming machine cabinet kit according to claim 1, wherein a depth of the top surface of the third cabinet is longer than a depth of the bottom surface of any one of the first cabinet including the first display, the first cabinet including the third cabinet and the second cabinet by at least 3 inches.

3. The gaming machine cabinet kit according to claim 2, further comprising:

a bill acceptor for inputting a bill for betting in the first game, wherein the bill acceptor is installed below the top surface of the third cabinet.

4. The gaming machine cabinet kit according to claim 2 further comprising:

a printer for printing data pertaining to bet information, wherein the printer is installed below the top surface of the third cabinet.

5. The gaming machine cabinet kit according to claim 2, wherein the top surface of the third cabinet extends from a front surface of any one of the first cabinet including the first display, and the first cabinet including mechanical reels, and wherein the second cabinet has a collar attached around an edge of a player side of the top surface of the third cabinet.

6. The gaming machine cabinet kit according to claim 1, wherein the third cabinet includes a front side surface recessed toward a rear side of the third cabinet, a recessed amount of the front side surface increasing throughout the front side surface from a most player side portion to a bottom section of the front side surface.

7. The gaming machine cabinet kit according to claim 1 further comprising:

a light device for being turned on and off according to progress of the first game and the second game under control of the controller, wherein the light device is attached between the first cabinet and the second cabinet.

8. The gaming machine cabinet kit according to claim 7, wherein the light device is visible from a front side of the gaming machine cabinet kit.

9. The gaming machine cabinet kit according to claim 1, wherein data communication between the first cabinet and the controller, and the second cabinet and the controller are performed through a communication device selected from the group consisting of a serial bus and a wireless communication device.

10. A gaming machine cabinet kit, comprising:

a first cabinet including a first display for displaying a first game;

a second cabinet including mechanical reels having a plurality of symbols, the second cabinet including the mechanical reels can be replaced by the second cabinet including a second display for a second game; and a third cabinet including an input device for playing the first game and the mechanical reels, the third cabinet having a top surface, a bottom surface, a front surface, and a rear surface, a fourth cabinet including a controller for controlling an operation of the first game and the mechanical reels, the fourth cabinet being placed between the second and the third cabinet, wherein the front surface of the third cabinet is increasingly recessed from the top surface to the bottom surface of the third cabinet toward the rear of the third cabinet, whereby space is provided along the front surface for a body of a player, wherein an area of the top surface of the third cabinet is greater than an area of a bottom surface of any one of the second cabinet including the mechanical reels, the second cabinet including the second display, and the first cabinet, wherein each of the first cabinet, the second cabinet including the mechanical reels, the second cabinet including the second display and the third cabinet has a mechanically independent modular structure being mechanically separable from each other, and wherein the top surface of the third cabinet protrudes at least three inches horizontally beyond the bottom surface of the second cabinet.

11. The gaming machine cabinet kit according to claim 10, wherein a depth of the top surface of the third cabinet is longer than a depth of the bottom surface of any one of the first cabinet, the second cabinet including the mechanical reels and the second cabinet including the second display by at least three inches.

12. The gaming machine cabinet kit according to claim 11 further comprising:

a bill acceptor for inputting a bill for betting in the first game and the second game, wherein the bill acceptor is installed below the top surface of the third cabinet.

13. The gaming machine cabinet kit according to claim 12 further comprising:

a printer for printing data pertaining to bet information of any one of the first game, the second game including the mechanical reels, and the second cabinet including the second display, wherein the printer is installed below the top surface of the third cabinet.

14. The gaming machine cabinet kit according to claim 11, wherein the top surface of the third cabinet extended from a front surface of any one of the first cabinet, the second cabinet including the mechanical reels and the second cabinet including the second display has a collar attached around an edge of a player side of the top surface of the third cabinet.

15. The gaming machine cabinet kit according to claim 10 further comprising:

a light device for being turned on and off according to progress of the first game and the second game under the control of the controller, wherein the light device is attached between the first cabinet and the second cabinet, and between the second cabinet and the fourth cabinet.

16. The gaming machine cabinet kit according to claim 15, wherein the light device is visible from a front side of the gaming machine.

17. The gaming machine cabinet kit according to claim 10, wherein data communication between the first cabinet and the controller, the second cabinet and the controller, and the third cabinet and the controller is performed through a communication device selected from the group consisting of a serial bus and a wireless communication device.

18. A gaming machine cabinet kit, comprising:

a first cabinet including a first display for playing a first game, the first cabinet including the first display can be replaced by the first cabinet including a third display;

a second cabinet including a second display for displaying a second game;

a third cabinet including a plurality of input buttons for playing the first game and the second game, an input device having an input slot and an output device having an output slot, the third cabinet having a top surface, a bottom surface, a front surface, and a rear surface; and a fourth cabinet including a controller for controlling at least the first display and the third display, the fourth cabinet being placed between the second and the third cabinet;

wherein the input slot is positioned not lower than a top surface of the input buttons located in front of the input slot, wherein each of the first cabinet including the first display, the first cabinet including the third display, the second cabinet, and the third cabinet has a mechanically independent modular structure being mechanically separable from each other, wherein the front surface of the third cabinet is increasingly recessed from the top surface to the bottom surface of the third cabinet toward the rear surface of the third cabinet whereby space is provide for a body of a player, wherein the top surface of the third cabinet protrudes at least three inches horizontally beyond a bottom surface of the second cabinet.

19. The gaming machine cabinet kit according to claim 18, wherein the top surface of the input button located in front of the input slot or the output slot is positioned in a distance range of 6 mm to 25.4 mm lower than the input slot of the input device.

20. The gaming machine cabinet kit according to claim 18, wherein the input device is a bill acceptor.

21. The gaming machine cabinet kit according to claim 18, wherein the output device is a printer.

22. The gaming machine cabinet kit according to claim 18, wherein the input device is selected from the group consisting of a card reader and a card reader/writer, wherein the card reader/writer is capable of reading and writing data on a card type medium.

23. The gaming machine cabinet kit according to claim 18, wherein at least one of the plurality of input buttons is located on a side surface of the third cabinet.

24. The gaming machine cabinet kit according to claim 23, wherein a center of the input button located on the side surface of the third cabinet is positioned in a distance range of 20 mm to 170 mm lower than the input slot of the input device and the output slot of the output device.

25. The gaming machine cabinet kit according to claim 23, wherein the at least one of the plurality of input buttons is an input button for starting the game.

26. The gaming machine cabinet kit according to claim 23, wherein the at least one of the plurality of input buttons is used for a bonus game.

* * * * *